United States Patent [19]

Owens

[11] 3,931,688

[45] Jan. 13, 1976

[54] POCKET-SIZE COMBINATION STORAGE AND DISPLAY CASES FOR INSIGNIA MEMBERS

[76] Inventor: John C. Owens, 1611 17th St., Bedford, Ind. 47421

[22] Filed: July 16, 1974

[21] Appl. No.: 488,973

[52] U.S. Cl. ..... 40/1.5

[51] Int. Cl.[2] ..... A44C 3/00

[58] Field of Search ..... 150/35, 40, 39, 34; 40/129 A, 10, 1.5; 224/26 R, 26 D; 206/37, 38

[56] References Cited

UNITED STATES PATENTS

| | | | |
|---|---|---|---|
| 2,285,670 | 6/1942 | Logsdon | 40/1.5 X |
| 3,318,354 | 5/1967 | Borisof | 206/37 |
| 3,407,636 | 10/1968 | Kovacevic | 150/40 |
| 3,660,915 | 5/1972 | Davis | 40/10 R |
| 3,716,091 | 2/1973 | Gaines | 206/37 |

*Primary Examiner*—Louis G. Mancene
*Assistant Examiner*—Wenceslao J. Contreras
*Attorney, Agent, or Firm*—Robert Brown, Jr.

[57] ABSTRACT

A combination identification storage and display case adapted to serve the dual purpose of storing an attached insignia member therein and of fitting in a garment pocket while displaying the member on the pocket exterior.

4 Claims, 6 Drawing Figures

IDENTIFICATION CARD
10
11
12
13
13a
13b
13c
13d
14
15
16
17
18
19
20
20a
21
22
22a
23
24
26
30
4
5

POCKET-SIZE COMBINATION STORAGE AND DISPLAY CASES FOR INSIGNIA MEMBERS

This invention relates to identification devices and more especially to a combination insignia storage and display folder which may be worn on or carried within garment pockets.

Heretofore, many types of conventional pocket-supported identification devices have been used, such as those disclosed in U.S. Pat. Nos. 3,280,488; 3,371,829; 3,295,235; and 3,660,915. So far as applicant is aware, however, none of these items comprise a folder with a storage recess therein and with an insignia member permanently attached thereto in such a manner that it may be exhibited in plain view while folder occupies the pocket, or alternatively, stored entirely within the folder.

The present invention may be used by public and private officials, security agents, investigators, toy manufacturers and by many other users where it is desirable to quickly convert insignia members to and from stored and displaying positions without risk of loss or misplacement due to separation of parts.

It is therefore an object of this invention to provide a pocket-size case which may serve alternatively as an identification display and as an identification storage while positioned on or in a garment pocket.

It is another object of this invention to provide a unitary foldable display and storage wallet which, when partially folded, the unfolded part will exhibit an insignia member in plain view while the folded part occupies a garment pocket.

It is yet another object of this invention to provide an article of the class described which is attractive in appearance, compact, simple in construction, relatively inexpensive to manufacture, and capable of being quickly adapted to either display or to store an insignia member.

Some of the objects of invention having been stated, other objects will appear as the description proceeds when taken in connection with the accompanying drawings, in which, FIG. 1 is an isometric view of an insignia holding folder or case according to my invention and mounted in display position on a garment pocket;

Figure 1:
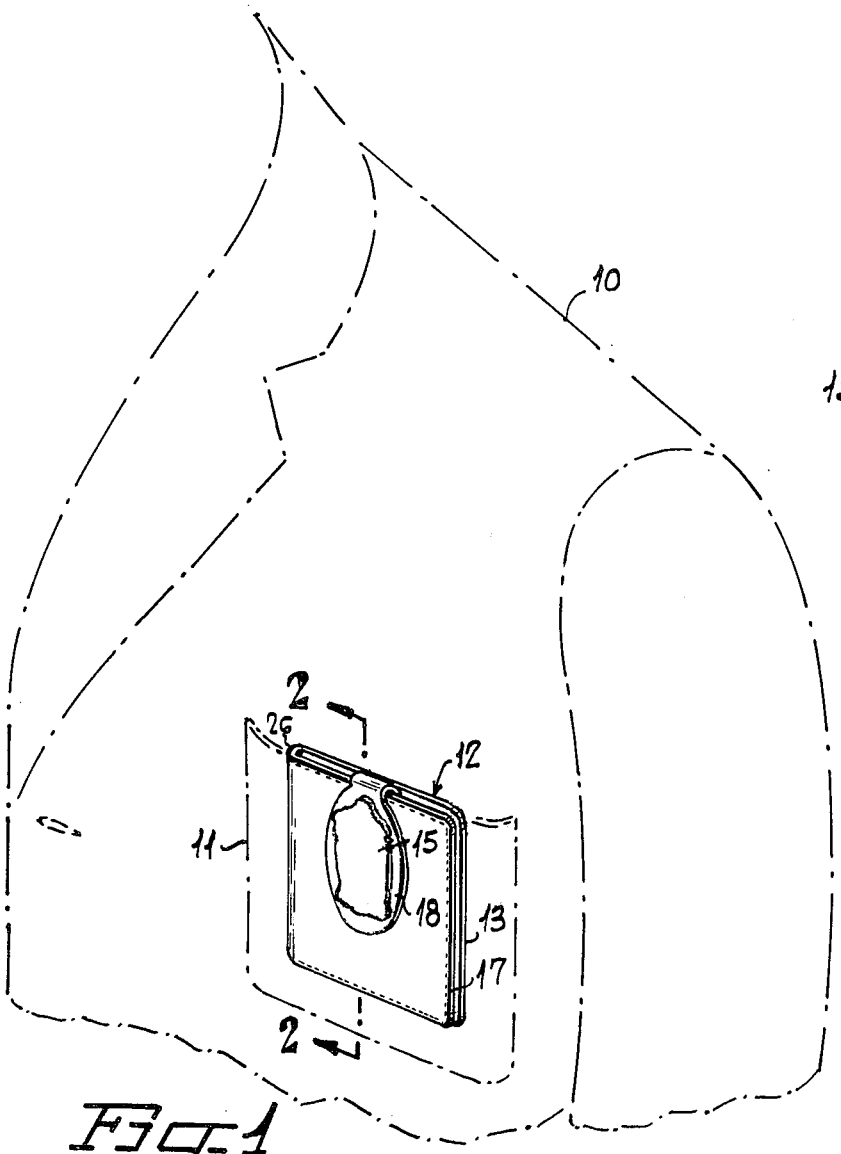

Referring more particularly to the drawings, the numeral 10 denotes a garment having a pocket 11 adapted to accommodate my improved combination insignia storage and display case 12. Briefly stated and as better illustrated in FIG. 3, the case 12 includes: a flat rectangular insignia holding section 13 having a recess 14 in one face thereof in which an insignia member 15 may be stored; a flat rectangular sheet-like cover member or closure section 16 attached to one side of section 13 and adapted to fold over said recess; a second flat closure section 17 attached to a second side of section 13 and adapted to fold over cover section 16, and an insignia carrier or strap 18 having one end thereof attached to a third side of section 13, said strap being adapted to fold in face-to-face contact with the inside face of section 13 when the insignia member is stored within recess 14. The insignia member 15 is detachably secured to the free end portion of strap 18. Closure section 17 further serves as a mount for identification cards 19 and the like.

Figure 2:
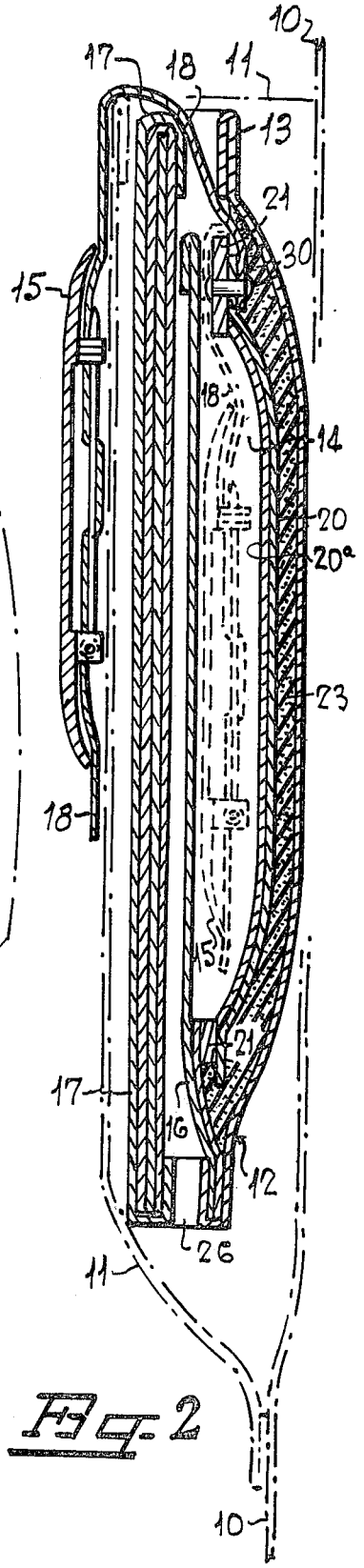
FIG. 2 is an enlarged vertical sectional view taken along line 2—2 in FIG. 1.

When the case 12 is supported by garment pocket 11 with the insignia member 15 in display position as shown in FIGS. 1 and 2, the sections 13, 16 and 17 are folded in parallel relation one to the other and positioned within the pocket. At this time, the insignia member is suspended on strap or carrier 18 which passes upwardly over the upper edges of pocket 11 and section 17, and then downwardly between sections 17 and 13 to point 30 where it is secured to annular frame 21 and accompanying spoon-shaped member 20 to be described later. On the other hand, when case 10 is folded with the insignia member 15 stored in recess 14, as shown in dotted lines in FIG. 2, the case may be carried within the pocket or by hand as desired. The length of strap 18 between the anchorage point 30 and the insignia 15 must be at least equal to the distance between the point 30 and the storage compartment 14 in order to permit the insignia to be transferred from its display to its stored position while attached to the case 12.

By making the insignia member 15 a part of the case as described above, the assembly will always remain connected regardless of whether used to display or to store the insignia member, thus eliminating the possibility of loss due to separation.

A closer examination of the drawings will reveal that the recess 14 of insignia-receiving section 13 includes a relatively rigid concavo-convex spoon-shaped member 20 having a flange or frame 21. A relatively soft cover **20*a* is secured on the concave face of member 20 to serve as a wearing surface. The frame or flange 21 supplements the rigidity of the spoon-shaped member 20, and further serves to stabilize the anchorage point 30 of strap 18 and as a base to which a relatively soft leather-like cover 22 is attached. A suitable filler material 23, such as sponge rubber, is disposed adjacent the outer or convex face of spoon-shaped member 20, said material being confined in position by means of an outside cover 24 of section 13**.

It is important to note that the spoon-shaped framed member 20, 21 affords the necessary rigidity to protect the insignia 15 from damage due to crushing or improper handling when it is in stored position. The surrounding relatively soft cover and filler materials relieve the wearer of the case from physical discomforts which would otherwise result from the relatively rigid compartment construction.

The covers 22 and 24 are secured together along the marginal sides **13*a* and 13*b* by any suitable means such as stitching or an adhesive (FIGS. 3 and 5); and along the marginal side 13*c*, said covers and one side of closure 16 are secured together in a similar manner. The fourth side 13*d* of section 13 is connected to the second closure 17 by means of an intermediate relatively thin flexible bend section 26. As previously stated, the closure 17** also serves to encase identification cards and the like.

It is to be understood that the invention contemplates the use of either one or both of the closures 16 and 17 in combination with section 13 and insignia carrier 18.

Although the closure 16 is primarily designed to protect insignia member 15 when stored in recess 14, it can also serve alone the dual purpose served by both closures with obvious modification. Likewise, the closure 17 may serve alone the dual purpose served by both closures as shown in FIG. 6.

Figures 3, 4, 5, 6:
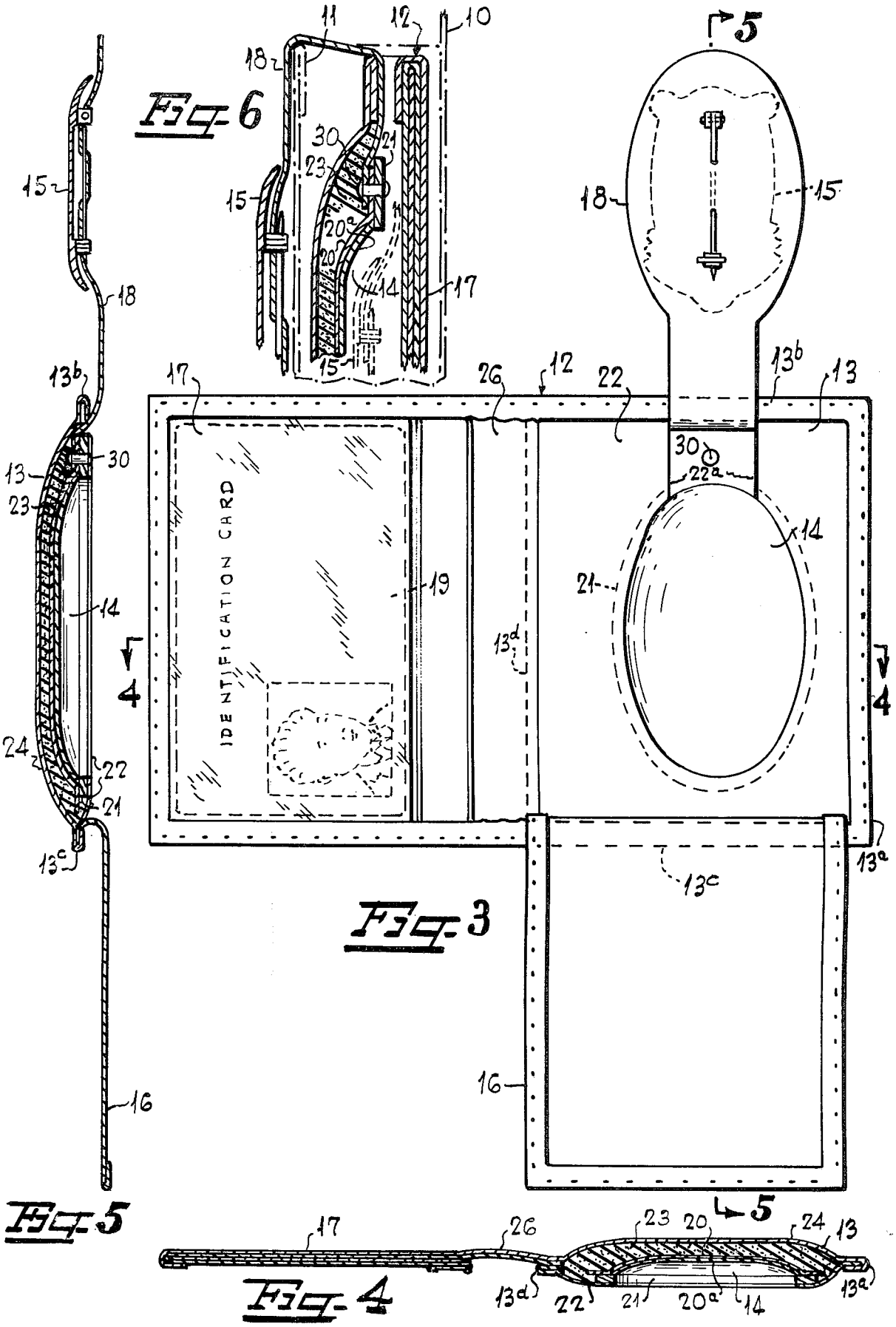
FIG. 3 is a plan view looking at the inside face of the folder when completely unfolded.
FIG. 4 is a sectional view taken along line 4—4 in FIG. 3.
FIG. 5 is a sectional view taken along line 5—5 in FIG. 3.
FIG. 6 is an enlarged fragmentary view similar to the upper portion of FIG. 2, but showing a slight modification of the invention.

FIG. 6 further shows a slightly different manner of suspending the carrier strap and associated insignia member 15 in display position on the garment pocket 11. In this modification, the member 15 is attached to the opposite face of carrier strap from that shown in FIGS. 1–3. Also when the insignia member is displayed on the exterior of upright pocket 11, the section 13 faces outwardly whereas in FIGS. 1 and 2, the section 17 is disposed outwardly adjacent the outer layer of the pocket. Thus, in FIG. 6 the strap 18 passes over the upper edge of section 17 and then is suspended, rather than over the upper edge of section 13.

I claim:

1. A unitary insignia storage and display case (12) for use on an upright garment pocket (11) having a front and a back panel, the upper marginal edge of the front panel being substantially horizontal and cooperating with the back panel to form a pocket opening, said case comprising:

a pair of integral rectangular sections (13, 17) foldable to parallel positions in which at least two of the side edges of the respective sections sunstantially coincide;

said folded sections (13, 17) being insertable through said opening and into said pocket with said coinciding side edges uppermost and adjacent said upper marginal pocket edge;

the inner face of one of said folded sections (13, 17) being recessed to form a storage compartment (14) for said insignia (15);

a flexible suspension strap (18);

means (30) for securing one end of said strap (18) to said recessed section (13);

said strap (18) extending laterally from said securing means (30), across said upper marginal edge of said pocket (11), and then downwardly alongside the exterior of the front panel of said pocket, and means for securing said insignia (15) to said downwardly extending strap portion, the strap length between said securing means (30) and said insignia (15) being at least equal to the distance between the securing means and said compartment (14) whereby said insignia while connected to the case may be selectively displayed in suspended position on the exterior of said pocket front panel or stored within said compartment.

2. The improvement defined in claim 1 and further comprising a rectangular sheet-like member (16) having one edge thereof attached to a side edge (13*c*) of said recessed section (13) and foldable transversely of the direction of fold of said first-named sections (13, 17) to a position covering the recess of said compartment (14).

3. The improvement as defined in claim 2 wherein said compartment (14) includes a rigid concavo-convex framed member (20, 21) and wherein the remaining portion of said recessed section (13) consists of relatively soft flexible materials in which the concavo-convex member is embedded, said strap securing means (30) being anchored to said concavo-convex member.

4. The improvement defined in claim 1 wherein said compartment (14) includes a rigid concavo-convex framed member (20, 21) and wherein the remaining portion of said recessed section (13) consists of relatively soft flexible materials in which the concavo-convex member is embedded, said strap securing means (30) being anchored to said concavo-convex member.

* * * * *